United States Patent [19]

Shelton

[11] 4,222,264

[45] Sep. 16, 1980

[54] YARN MONITORING DEVICE

[75] Inventor: William E. A. Shelton, Leicester, England

[73] Assignee: Alan Shelton Limited, Croft, England

[21] Appl. No.: 83,235

[22] Filed: Oct. 10, 1979

[30] Foreign Application Priority Data

Oct. 12, 1978 [GB] United Kingdom ..... 40374/78

[51] Int. Cl.[3] ..... G01L 5/04; D01H 13/16; D01H 13/22

[52] U.S. Cl. ..... 73/160; 28/228; 57/80; 242/35.6 R

[58] Field of Search ..... 73/159, 160; 28/188, 28/189, 227, 228; 57/78.80; 242/35.5 R, 35.6 R, 36

[56] References Cited

U.S. PATENT DOCUMENTS

| | | | |
|---|---|---|---|
| 1,939,348 | 12/1933 | Higginson | 57/80 X |
| 3,063,007 | 11/1962 | Baugh et al. | 73/160 X |
| 3,380,134 | 4/1968 | Anders | 73/160 X |
| 3,511,448 | 5/1970 | Brouwer et al. | 242/36 |
| 3,739,996 | 6/1973 | Matsui et al. | 242/36 X |
| 3,880,001 | 4/1975 | Hogan | 73/160 |
| 4,075,744 | 2/1978 | Mista et al. | 242/35.6 R X |

*Primary Examiner*—Donald Watkins
*Attorney, Agent, or Firm*—Charles E. Brown

[57] ABSTRACT

Yarn $Y_1$, $Y_2$ being supplied to a textile machine is led over a pair of spaced hooks 24 on a support member 22 and is contacted between the hooks by a pivotable member 12 when in an inoperative position (shown in broken lines). In the event of breakage of yarn, the member 12 pivots into an operative position (shown in full lines) and operates a proximity switch 18 to halt operation of the textile machine. In the event of snatching, the increased tension in the yarn lifts the support member 22 off a magnetic block 26, again causing the member 22 to pivot to its operative position and thereby halt operation of the textile machine. After the snatch has passed, a weight 27 which the support member 22 engages after initial lifting thereof returns the support member 22 to its original position under gravity and the yarn forces the pivotable member 12 back into its inoperative position so that operation of the textile machine can recommence.

9 Claims, 2 Drawing Figures

YARN MONITORING DEVICE

The invention is concerned with improvements in or relating to yarn monitoring devices.

In the supply of yarn to a textile machine it is necessary to prevent faults in the yarn supply from adversely affecting the quality of the fabric produced by the textile machine, for example a knitting machine. Yarn faults may take the form either of a weakness, perhaps a badly tied knot, which causes an actual break or the yarn windings on the supply package may become entangled or overwrapped due to mishandling and may cause "snatching", that is, sudden increases of tension which, although not necessarily resulting in breakage, do affect the fabric production.

It is known to provide detector means for sensing a break or snatch in the yarn and causing a stop motion device to operate and halt the machine before the fabric is damaged. However, where the machine is halted because of a momentary "snatch" it is inconvenient for an operator to have to re-start the machine where no remedial action is necessary. It is therefore desirable to provide a device which in the event of a temporary and self-righting fault in the yarn supply is capable of signalling the textile machine to re-commence operation when the fault is righted.

Previous attempts at producing such a device have been limited to use with relatively low yarn tension levels, but as it has become more common to use higher tensions, so these devices have accentuated short-comings such as the rubbing off of loose fibres or lint because of excessive friction. Cleaning away this lint is time-consuming and made onerous because the device is situated high on the machine to provide an adequate reservoir of yarn which may be released when the yarn snatches to prevent breakage occurring before the machine can be halted. Moreover such devices tend to be mechanically very complicated.

It is an object of the invention to minimise the above mentioned disadvantages.

The invention therefore provides a yarn monitoring device for a textile machine comprising a main frame portion, a pivotable yarn-contacting member mounted on the frame portion for movement between an operative position towards which it is biassed and in which a signal is sent to bring said textile machine to a halt, and an inoperative position in which it is held when the yarn is being supplied at normal tension, a support member mounted for movement towards or away from the main frame portion and having yarn-engaging means secured thereto, the support member normally being disposed in a first position in which the yarn-engaging means causes the yarn to contact the pivotable member and hold it in its inoperative position, the construction and arrangement being such that on snatching or breakage of the yarn the latter is removed from its contact with the pivotable member which then takes up its operative position.

Advantageously the support member may be slidably mounted heightwise with respect to the main frame portion and in the event of a snatch will be lifted by the sharp increase in yarn tension to remve the yarn from contact with the pivotable member. A weight can also be slidably mounted heightwise with respect to the main frame portion and is arranged to be engaged by the support member after initial lifting thereof.

Desirably, the support member is arranged to be returned to its first position after snatching of the yarn when the snatch has passed, thereby bringing the yarn back into contact with the pivotable member and returning the latter to its inoperative position.

Conveniently, the support member is normally held in its first position by light magnetic means and is returned from a second raised position by gravity when the snatch has passed. The return of the support member to its inoperative position can be arranged to produce a signal to re-commence operation of said textile machine.

Of course the support will not move in the event of simple yarn breakage without snatching, but the pivotable member will move to its operative position because the yarn is not there to retain it in its inoperative position. The machine may be re-started only when the yarn is re-instated.

Preferably, the support member includes a pair of spaced hooks over which the yarn is guided, and the pivotable member in its inoperative position has a portion which is disposed in the space between the hooks for contact with said yarn.

The pivotable member is advantageously biased towards its operative position by a counter-balance weight. In this case, the counter-balance weight can operate a proximity switch for controlling operation of said textile machine when the pivotable member is in its operative position.

There will now be described an example of a device according to the invention. It will be understood that the description accompanying the drawings is given by way of example only and not by way of limitation of the invention.

Figure 1:
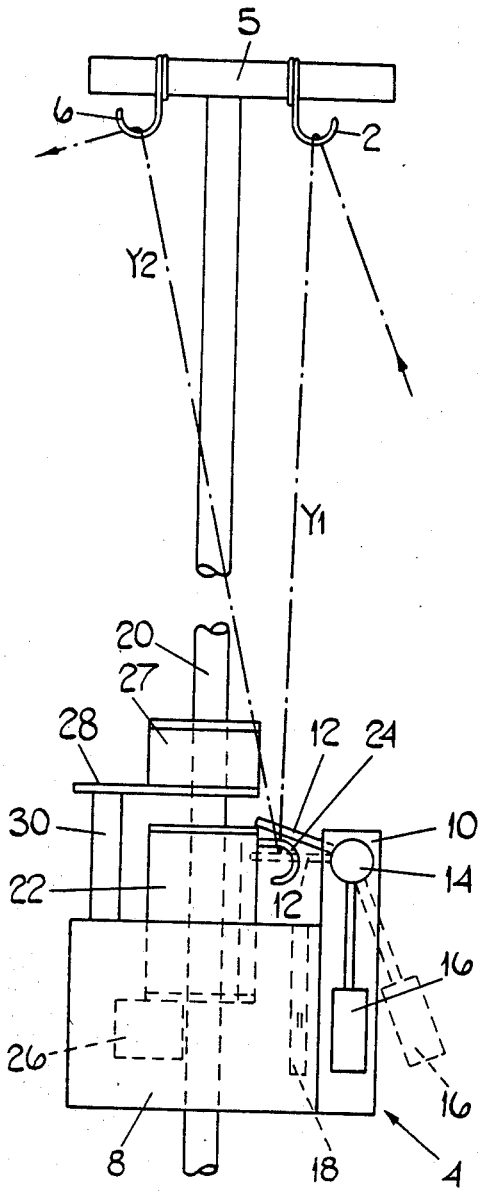
FIG. 1 is a side elevational view of the device during normal operation.

FIG. 1 shows a yarn travelling along a path $Y_1$ from a supply cone (not shown) to a yarn guide 2, through a device, indicated at 4 and in accordance with the invention, and along a path $Y_2$ to a yarn guide 6 and on towards a knitting machine (not shown). The yarn guides 2 and 6 are supported on a bracket 5.

The device 4 comprises a main open frame portion 8 on an extension 10 of which is mounted a pivotable member 12 which pivots on a rod 14 between an operative position (shown in full lines) and an inoperative position (shown in broken lines in FIG. 1). A counter-balance weight 16 biasses the member 12 into its operative position in which the weight 16 operates a proximity switch 18 under circumstances which will be explained below.

Connecting the bracket 5 and the frame portion 8 is a vertical bar 20 having a D-shaped cross-section. Mounted for sliding movement on the bar is a support member 22 for two spaced-apart guide hooks 24.

This support member 22 when in its normal position rests against and is retained in position by a magnetic block 26. A weight 27 is also slidably mounted on the bar 20 at a rest position maintained above and spaced from the support member by means of a flange 28 contacting a stop pillar 30.

The operation of the device is as follows:

Normal conditions

Figure 2:
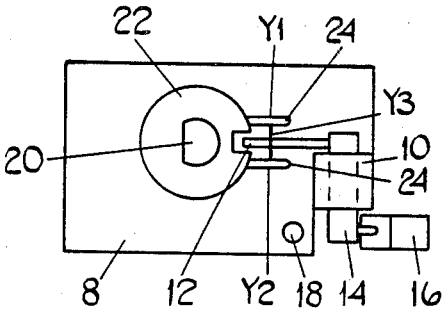
FIG. 2 is a view of a part of the device in the direction of arrow II during a snatch.

The yarn on its path $Y_1$ approaches the guide hooks 24 from the guide 2. These hooks are downwardly formed so that the yarn passes beneath them and a portion of the yarn path $Y_3$ which spans the intervening space as can be best seen in FIG. 2. The presence of yarn under normal tension in the yarn path Y3 ensures that the pivotable member 12 is maintained in its inoperative position with the counterbalance weight 16 spaced from the proximity switch 18.

Yarn snatch

This comprises a temporary increase in the yarn tension and will be such as to overcome the effect of the magnetic block 26 and to allow the support member 22 to rise on the bar 20 as the yarn pulls on the hooks 24 in an upwardly direction. The rising member 22 engages the underside of the weight 27 and lifts the weight until the increased tension in the yarn ceases. The support member will then slide back down the bar assisted by the weight 27. However, the first upward movement of the support member has lifted the yarn path $Y_3$ out of contact with the pivotable member 12 which then moves into its operative position in which the counter balance weight 16 operates the proximity switch 18 which gives a signal to the knitting machine to stop.

Where the yarn does not break and the tension returns to normal after the snatch, the return of the support member 22 to its lower position restores the presence of the yarn in path $Y_3$ in a position in which the pivotable member is returned to its inoperative position. The counterbalance weight 16 swings away from the proximity switch and the stop signal ceases. Means are provided automatically then to restart the knitting machine.

Yarn Breakage

Whether or not yarn breakage is preceded by an increase in yarn tension sufficient to raise the member 22, the absence of yarn in yarn path $Y_3$ will allow the pivotable member 12 to move into its operative position so that the knitting machine stops. In this case, the machine will not re-start until the yarn supply has been restored.

Various modifications may be made within the scope of the invention.

I claim:

1. A device for monitoring the supply of yarn to a textile machine, comprising a main frame portion, a pivotable yarn-contacting member mounted on said main frame portion for movement between an operative position and an inoperative position, signal means operative to produce a signal for bringing said textile machine to a halt in response to movement of said pivotable member into said operative position, means biassing said pivotable member towards said operative position, a support member mounted for movement into and out of a predetermined position relative to said main frame portion, and yarn-engaging means secured to said support member, said support member occupying said predetermined position when said yarn is supplied at normal tension and said yarn-engaging means holding said yarn in contact with said pivotable member so as to hold said pivotable member in said inoperative position, snatching or breakage of said yarn causing said yarn to be removed from its contact with said pivotable member so that said pivotable members moves into said operative position.

2. The device according to claim 1, wherein said support member is mounted for upward and downward sliding movement with respect to said main frame portion, snatching of said yarn causing said support member to be lifted out of said predetermined position to remove said yarn from its said contact with said pivotable member.

3. The device according to claim 2, further comprising a weight mounted for upward and downward sliding mvement with respect to said main frame portion, said weight being engaged by said support member after initial lifting thereof.

4. A device according to claim 1, further comprising means operative to return said support member into said predetermined position and thereby bring said yarn back into contact with said pivotable member to return said pivotable member to said inoperative position when a snatch has passed after snatching of said yarn.

5. The device according to claim 4, further comprising light magnetic means operative to hold said support member releasably in said predetermined position, said support member being returned to said predetermined position after lifting by gravity.

6. The device according to claim 4, wherein said signal means is also operative to produce a signal for recommencing operation of said textile machine in response to the return of said pivotable member to said inoperative position.

7. The device according to claim 1, wherein said yarn-engaging means include a pair of spaced hooks over which said yarn is guided, and said pivotable member has a portion which is disposed between said hooks for engagement with said yarn when said pivotable member is in said inoperative position.

8. The device according to claim 1, wherein said biassing means is a counter-balance weight on said pivotable member.

9. The device according to claim 8, wherein said signal means includes a proximity switch operated by said counter-balance weight.

* * * * *